US011798518B2

(12) United States Patent
Chen

(10) Patent No.: US 11,798,518 B2
(45) Date of Patent: Oct. 24, 2023

(54) IMAGE PROCESSING DEVICE AND IMAGE PROCESSING METHOD FOR DISPLAYING MULTI-SCREEN

(71) Applicant: Aten International Co., Ltd., New Taipei (TW)

(72) Inventor: Yi-Jen Chen, New Taipei (TW)

(73) Assignee: Aten International Co., Ltd., New Taipei (TW)

( * ) Notice: Subject to any disclaimer, the term of this patent is extended or adjusted under 35 U.S.C. 154(b) by 0 days.

(21) Appl. No.: 17/383,452

(22) Filed: Jul. 23, 2021

(65) Prior Publication Data

US 2022/0130349 A1 Apr. 28, 2022

(30) Foreign Application Priority Data

Oct. 23, 2020 (TW) ..... 109136790

(51) Int. Cl.
*G09G 5/38* (2006.01)

(52) U.S. Cl.
CPC ..... *G09G 5/38* (2013.01); *G09G 2360/12* (2013.01); *G09G 2360/18* (2013.01)

(58) Field of Classification Search
CPC ..... G09G 5/38; G09G 2360/18
See application file for complete search history.

(56) References Cited

U.S. PATENT DOCUMENTS 7,262,746 B2 8/2007 Lagarrigue et al.
2014/0063034 A1* 3/2014 Abarca ..... G09G 5/399 345/545

FOREIGN PATENT DOCUMENTS

TW 201010436 3/2010
TW 201010436 A * 3/2010
TW 201304502 1/2013
TW 201304502 A * 1/2013

OTHER PUBLICATIONS

TW-201304502-A English Translation (Year: 2013).*
TW-201010436-A English Translation (Year: 2010).*
"Office Action of Taiwan Counterpart Application", dated Oct. 28, 2021, p. 1-p. 11.

* cited by examiner

*Primary Examiner* — Samantha (Yuehan) Wang
(74) *Attorney, Agent, or Firm* — JCIPRNET

(57) ABSTRACT

An image processing device and method for displaying multi-screen are provided. The image processing device includes an image processing circuit, a transmission arrangement circuit, and an image merge circuit. The image processing circuit receives and processes a first image information with a first bandwidth and a second image information with a second bandwidth to generate a first image information package and a second image information package which are transmitted to the transmission arrangement circuit. The image merge circuit receives and restores the first image information package and the second image information package from the transmission arrangement circuit with a third bandwidth, and outputs the first image information package and the second image information package to a display together. When the first image information and the second image information are in a full-screen mode, the third bandwidth is less than a sum of the first bandwidth and the second bandwidth.

16 Claims, 7 Drawing Sheets

540

IMAGE PROCESSING DEVICE AND IMAGE PROCESSING METHOD FOR DISPLAYING MULTI-SCREEN

CROSS-REFERENCE TO RELATED APPLICATION

This application claims the priority benefit of Taiwan application serial no. 109136790, filed on Oct. 23, 2020. The entirety of the above-mentioned patent application is hereby incorporated by reference herein and made a part of this specification.

BACKGROUND OF THE INVENTION

Field of the Invention

The invention relates to an image processing technique, and more particularly to an image processing device and an image processing method reducing bandwidth requirements to achieve multi-screen display.

Description of Related Art

Existing TV walls or multi-screen displays usually receive a plurality of image screens from a plurality of image sources and output the image screens to the same screen by partial overlap or reducing the display screen, for example. In particular, the portion of the image that is blocked and not displayed due to the overlap of the display screen still occupies the memory and transmission bandwidth of the hardware equipment. For example, as the number of image sources is increased, the bandwidth requirements of the hardware equipment is increased proportionally, and the computing resources of the hardware equipment are significantly occupied, thus affecting the quality of the display images, and the images may not all be displayed at a size close to full screen.

SUMMARY OF THE INVENTION

Accordingly, the invention provides an image processing device and an image processing method for displaying a multi-screen that may reduce the cost of the hardware structure and may reduce bandwidth requirements in the case of a full screen.

The image processing device of the invention includes an image processing circuit, a transmission arrangement circuit, and an image merge circuit. The image processing circuit receives a first image information with a first bandwidth, receives a second image information with a second bandwidth, and processes the first image information and the second image information to generate a first image information packet and a second image information packet. The transmission arrangement circuit receives the first image information packet and the second image information packet. The image merge circuit receives the first image information packet and the second image information packet from the transmission arrangement circuit with a third bandwidth, restores the first image information packet and the second image information packet to the first image information and the second image information, and outputs the first image information and the second image information to a display together. In particular, when the first image information and the second image information are in a full-screen mode, the third bandwidth is less than a sum of the first bandwidth and the second bandwidth.

The image processing method for displaying a multi-screen of the invention is suitable for an image processing device including an image merge circuit and a display, and includes the following steps. A first image information is obtained with a first bandwidth, a second image information is obtained with a second bandwidth, and the first image information and the second image information are processed to generate a first image information packet and a second image information packet. The first image information packet and the second image information packet are transmitted to the image merge circuit with a third bandwidth. The first image information packet and the second image information packet are restored to the first image information and the second image information by the image merge circuit. The first image information and the second image information are outputted to a display together. In particular, when the first image information and the second image information are in a full-screen mode, the third bandwidth is less than a sum of the first bandwidth and the second bandwidth.

Based on the above, the image processing device and the image processing method for displaying a multi-screen of an embodiment of the invention may process a plurality of image sources to reduce the data volume of undisplayed images that are blocked due to overlapped display screens, so that the undisplayed images do not occupy the transmission bandwidth of the hardware equipment. In this way, under the premise of maintaining refresh rate and not affecting display image quality, the number of superimposed input images and the display size of the image screens are not limited. Moreover, the image screens may all be displayed in a size close to full screen, and there is no need to increase the transmission bandwidth and temporary storage space for the image processing device to process and transmit the image screens, thereby saving costs and reducing the complexity of hardware design.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
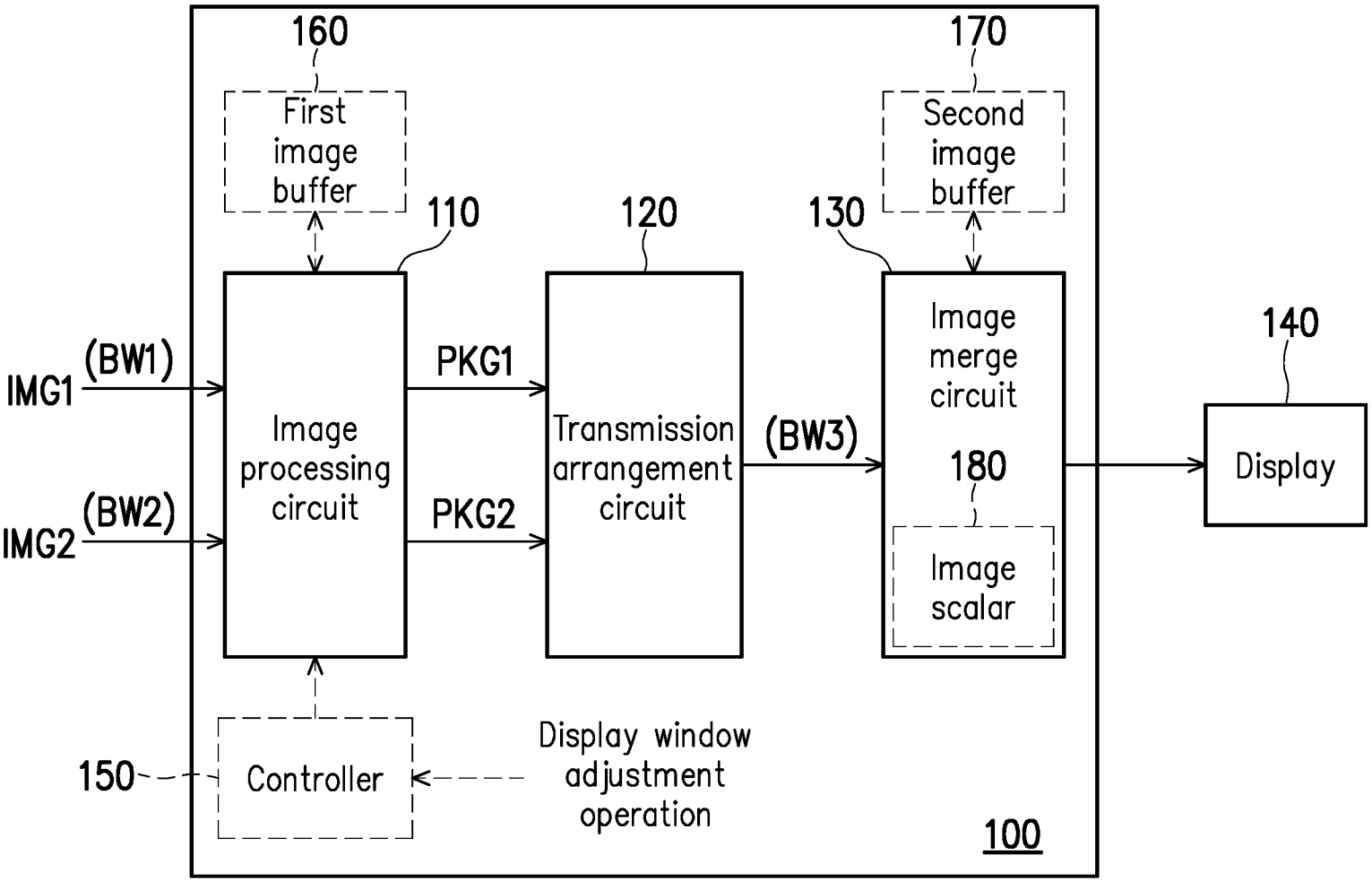
FIG. 1 is a block diagram of an image processing device according to an embodiment of the invention.

FIG. 1 is a block diagram of an image processing device 100 according to an embodiment of the invention. Please refer to FIG. 1, the image processing device 100 mainly includes an image processing circuit 110, a transmission arrangement circuit 120, and an image merge circuit 130. The image processing circuit 110, the transmission arrangement circuit 120, and the image merge circuit 130 may each be built in or externally connected to the image processing device 100, the connection mode thereof may be wired or wireless transmission, and the invention is not limited in this regard.

In other words, the image processing device 100 may be implemented by being integrated into a single equipment to reduce the wiring area of the circuit board and increase the working efficiency of circuit elements. Alternatively, the image processing device 100 may be implemented by a plurality of electronic devices connected to each other. The type of the display 140 may be liquid crystal display (LCD), light-emitting diode (LED) display, field-emission display (FED), organic light-emitting diode (OLED), or other types of displays.

The image processing circuit 110 is configured to receive and process a plurality of image sources. When a plurality of image sources are stacked on top of each other on the display screen of the display 140, the data volume of image pixels blocked by the images due to the stacking may be reduced, thereby reducing the transmission bandwidth needed. In the present embodiment and FIG. 1, two image sources are used as examples. Those having ordinary skill in the art may add more image sources according to design requirements. For example, in FIG. 2, four image sources are used as an example, and the embodiments of the invention are not limited in this regard. In the present embodiment, the image processing circuit 110 may respectively receive a first image information IMG1 according to a first bandwidth BW1, receive a second image information IMG2 according to a second bandwidth BW2, and process the first image information IMG1 and the second image information IMG2 (for example, by masking) to generate a first image information packet PKG1 and a second image information packet PKG2 to reduce the transmission bandwidth requirements of the first image information packet PKG1 and the second image information packet PKG2. In the present embodiment, the image processing circuit 110 simultaneously receives the first image information IMG1 from the first source and receives the second image information IMG2 from the second source. In other embodiments, the image processing circuit 110 may not simultaneously receive the first image information IMG1 and the second image information IMG2 from the first source and the second source. The first bandwidth BW1 and second bandwidth BW2 may be the same or different from each other, and the first source and the second source may also be the same or different from each other.

The transmission arrangement circuit 120 may receive and arrange to transmit a plurality of image information packets to the image merge circuit 130. In the present embodiment, the transmission arrangement circuit 120 may transmit the first image information packet PKG1 and the second image information packet PKG2 to the image merge circuit 130 according to a third bandwidth BW3.

The image merge circuit 130 may receive and restore a plurality of image information packets, and then output the plurality of image information packages to the display 140 together for display. In the present embodiment, the image merge circuit 130 may receive and restore the first image information packet PKG1 and the second image information packet PKG2 to the processed first image information IMG1 and the processed second image information IMG2, and then output the processed first image information IMG1 and the processed second image information IMG2 together to the display 140. It should be mentioned here that, at this time, the data volume of image pixels of the processed first image information IMG1 and the processed second image information IMG2 is less than the original unprocessed first image information IMG1 and second image information IMG2. For example, if a portion of the first image information IMG and the second image information IMG2 is stacked on the display 140, the image pixels of the masked region (unviewable region) may not be transmitted to reduce the data volume thereof. In this way, the bandwidth and temporary storage space needed for processing and transmission are still maintained in a state equivalent to transmitting only a single image information. Therefore, when the first image information IMG1 and the second image information IMG2 are in full-screen mode, the third bandwidth BW3 is less than the sum of the first bandwidth BW1 and the second bandwidth BW2 (BW1+BW2>BW3). In other words, when a plurality of input sources are stacked on top of each other or are all in full-screen mode, the image processing device 100 of the invention may make the transmission bandwidth less than the sum of a plurality of input bandwidths without affecting display quality to achieve the effect of saving cost and reducing the complexity of hardware design. In particular, the first, second, and third bandwidths mentioned above may be the maximum bandwidths in the transmission specifications, and are all 5 Gbps, for example. However, the actual bandwidth used when transmitting data may not fully reach the upper limit of the bandwidth, depending on data volume.

In other embodiments, in addition to the image processing circuit 110, the transmission arrangement circuit 120, and the image merge circuit 130 shown in solid lines in FIG. 1, the image processing device 100 may also include a controller 150, a first image buffer 160, a second image buffer 170, and an image scaler 180 shown in dashed lines. Or, keyboards, speakers, various communication interfaces, etc. may be adopted, and the invention is not limited in this regard.

In an embodiment, the image processing circuit 110 may be coupled to the controller 150. The controller 150 may have input and output functions. For example, a display window may be provided for the user to view and adjust the image size and relative positions of a plurality of image sources displayed on the display 140, and to reduce the image pixels that need to be outputted according to the adjustment made by the user. For example, in the present embodiment, the controller 150 may adjust the masks respectively corresponding to the first image information IMG1 and the second image information IMG2 according to the adjustment operation on the display window (i.e., the display window adjustment operation in FIG. 1). The data volume of the image pixels that need to be outputted is reduced through a masking method, that is, the bandwidth requirements of the first image information packet PKG1 and the second image information packet PKG2 during transmission are reduced. Moreover, when the user adjusts the size of the display window of the image screens displayed by the display 140 in FIG. 1 through a mouse (not shown), the controller instantly receives the adjustment information of the display window size to inform the image processing circuit 110 to adjust the size of the corresponding mask instantly, so as to reduce the data volume of image pixels of the unviewable region blocked by the mask.

In an embodiment, the image processing circuit 110 may be coupled to the first image buffer 160 to temporarily store inputted image information. In an embodiment, the transmission arrangement circuit 120 continues to transmit image information packets to the image merge circuit 130. The image merge circuit 130 may be coupled to the second image buffer 170 to temporarily store the image information packets, and perform subsequent processing after reception is completed. The first image buffer 160 may be provided in the image processing circuit 110, and the second image buffer 170 may be provided in the image merge circuit 130, and the invention is not limited in this regard. The type of the first image buffer 160 and the second image buffer 170 may be any type of fixed or removable random-access memory (RAM), read-only memory (ROM), flash memory, or a combination thereof.

In an embodiment, the image merge circuit 130 may include an image scaler 180 configured to perform image scaling of the inputted image and adjust the display position on the display 140. According to different design requirements, the image processing circuit 110, the transmission arrangement circuit 120, the image merge circuit 130, the controller 150, and the image scaler 180 may be implemented in hardware, firmware, software (i.e., a program), or multiple combinations of the above three.

In terms of hardware, elements such as the image processing circuit 110, the transmission arrangement circuit 120, the image merge circuit 130, the controller 150, and the image scaler 180 may be logic circuits implemented on an integrated circuit. Alternatively, the elements may be implemented as hardware using a hardware description language (for example, Verilog HDL or VHDL) or other suitable programming languages. For example, the related functions of the image processing circuit 110, the transmission arrangement circuit 120, the image merge circuit 130, the controller 150, and/or the image scaler 180 may be implemented in one or a plurality of microcontrollers, microprocessors, application-specific integrated circuits (ASIC), digital signal processors (DSP), field-programmable gate arrays (FPGA), complex programmable logic devices (CPLD), and/or various logic blocks, modules, and circuits in other processing units.

In the form of software and/or firmware, the image processing circuit 110, the transmission arrangement circuit 120, the image merge circuit 130, the controller 150, and/or the image scaler 180 may be implemented as programming codes. For example, the above may be implemented using a general programming language (such as C, C++, or a combination language) or other suitable programming languages. The programming codes may be recorded/stored in a recording medium, and the recording medium includes, for example, a read-only memory (ROM), a storage device, and/or a random-access memory (RAM). A computer, a central processing unit (CPU), a microcontroller, or a microprocessor may read and execute the programming codes from the recording medium to achieve a related function. As the recording medium, a "non-transitory computer-readable medium" may be used. For example, a tape, a disk, a card, a semiconductor memory, a programmable logic circuit, etc. may be used. Moreover, the program may also be provided to a computer (or CPU) via any transmission medium (communication network or broadcast wave, etc.) The communication network is, for example, the Internet, wired communication, wireless communication, or other communication media.

Figure 2:
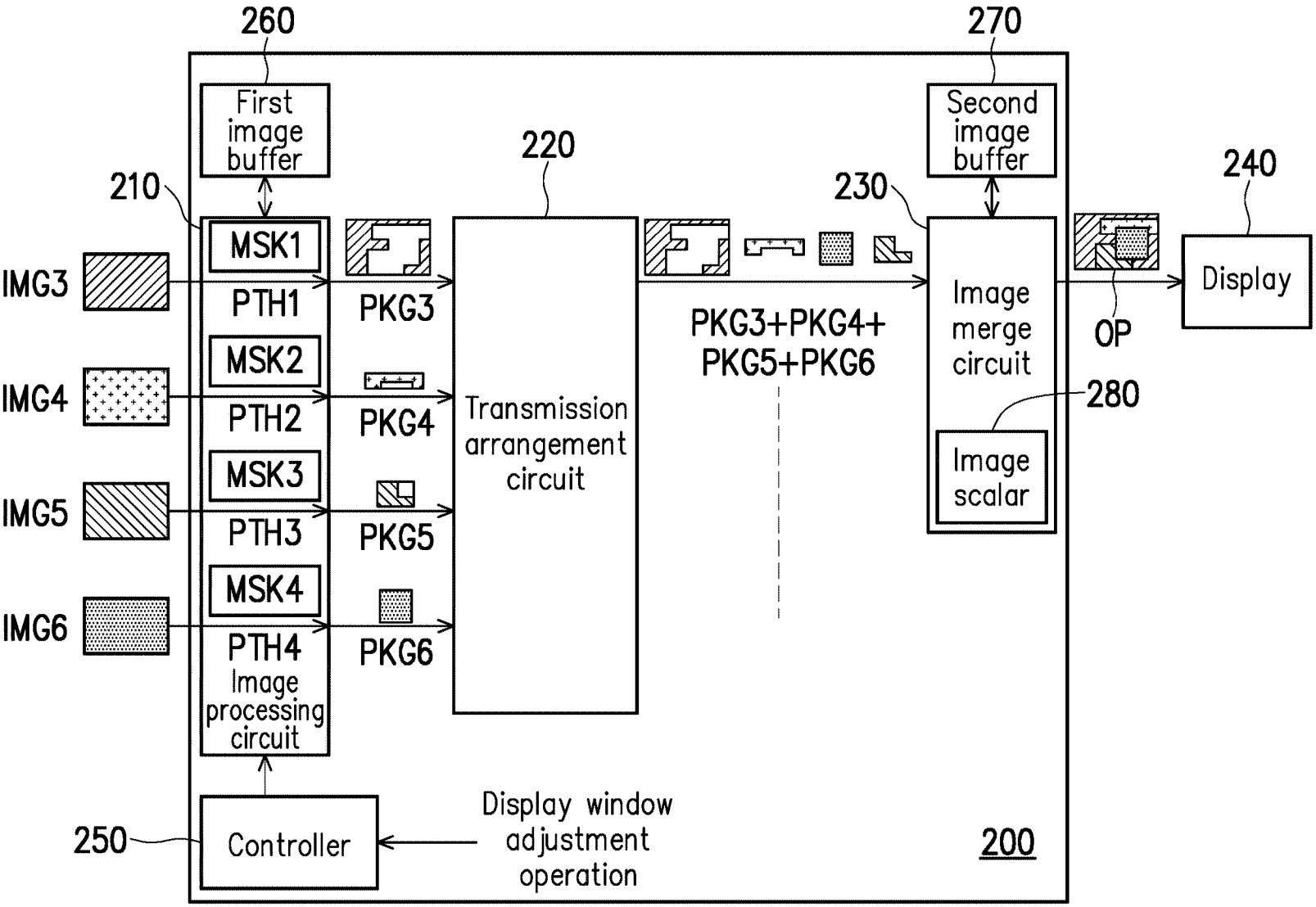
FIG. 2 is a diagram of an image processing device according to an embodiment of the invention.

Examples are listed below to illustrate the invention. Please refer to FIG. 2. FIG. 2 shows a diagram of an image processing device 200 according to an embodiment of the invention. The elements of the image processing device 200 and a display 240 in FIG. 2 are applicable to the elements of the image processing device 100 and the display 140 in FIG. 1. The image processing device 200 includes an image processing circuit 210, a transmission arrangement circuit 220, an image merge circuit 230, a controller 250, a first image buffer 260, a second image buffer 270, and an image scaler 280. In particular, the controller 250 and the first image buffer 260 are respectively coupled to the image processing circuit 210, and the second image buffer 270 is coupled to the image merge circuit 230.

In the present embodiment, the image processing circuit 210 receives image information IMG3 to IMG6 and temporarily stores the image information IMG3 to IMG6 in the first image buffer 260. The controller 250 may adjust masks MSK1 to MSK4 according to the display window adjustment operation inputted by the user, so that the image information IMG3 to IMG6 may respectively pass through paths PTH1 to PTH4 and the masks MSK1 to MSK4 to reduce the data volume of image pixels outputted and generate image information packets PKG3 to PKG6. Examples are provided below. In an embodiment, the masks MSK1 to MSK4 may be configured to represent a plurality of different image viewable regions relative to the full-screen region, and the plurality of different image viewable regions are not overlapped with each other. Here, the full-screen region may be the maximum display range of the display 240, and the image viewable region may be the display range of the image information IMG3 to IMG6 on the display 240 that is not blocked. In other words, the masks MSK1 to MSK4 may filter out the image pixels of the image information IMG3 to IMG6 that are blocked on the display 240 due to image stacking, so as to reduce bandwidth requirements during transmission.

The transmission arrangement circuit 220 receives the image information packets PKG3 to PKG6 generated by the image processing circuit 210 and transmits the image information packets PKG3 to PKG6 to the image merge circuit 230. The image merge circuit 230 may temporarily store the image information packets PKG3 to PKG6 using the second image buffer 270 and restore the image information packets PKG3 to PKG6 to a plurality of processed image information (the data volume of image pixels at this time is less than the original input image information IMG3 to IMG6), and then merge the plurality of processed image information into an output image OP after the size and display position are adjusted using the image scalar 280. In other words, for the user, the output image OP visually displays a screen in which the image information IMG3 to IMG6 stacked. But in fact, through the processing of the image processing device 200 of the invention, the blocked image pixel data may be reduced or not transmitted. Therefore, the transmission bandwidth needed for the transmission of the image information packets PKG3 to PKG6 may be reduced, and the temporary storage space needed for the temporary storage of the image information packets PKG3 to PKG6 may also be reduced. Based on the above, although the image processing device 200 receives four image information IMG3 to IMG6, the needed internal transmission bandwidth thereof is substantially only equivalent to the image data volume for transmitting any single image information IMG3 to IMG6. As a result, when the image information IMG3 to IMG6 are all displayed in full-screen mode on the display 240, the needed transmission bandwidth inside the image processing device 200 is less than the sum of the input bandwidth of the image information IMG3 to IMG6. Compared with the prior art that needs to increase the internal transmission bandwidth and temporary storage space when more image information is received, the invention may further save costs and reduce the complexity of hardware design.

In the present embodiment, the image information packets PKG3 to PKG6 may include a display image and an image setting information corresponding to the image information IMG3 to IMG6. The image scaler 280 may configure the display positions of the display images in the output image OP according to the image setting information, so as to integrate the processed image information into the output image OP. For example, the image scaler 280 may first configure the display position of the display image corresponding to the image information IMG3 in the output image OP according to the image setting information in the image information packet PKG3, then configure the display positions of a plurality of display images corresponding to the image information IMG4 to IMG6 in sequence to integrate as a complete output image OP. Here, the display image may be a viewable image in which the image information IMG3 to IMG6 are not stacked and blocked on the display 240. In an embodiment, the image setting information may be configured to indicate that the display image is located in different regions of the full-screen region of the display 240, and the regions are not overlapped with each other. In an embodiment, the image setting information may also include displacement information and size information of regions relative to the full-screen region. In other words, the image scaler 280 may configure the display positions of the display images on the output image OP according to the displacement information and the size information of the respective corresponding regions in the image setting information. In this way, the number of superimposed image sources may not be limited, and even under the premise of maintaining the refresh rate and not affecting display image quality, the bandwidth requirements for generating the output image OP is substantially maintained at the bandwidth requirement of a single image, thus significantly saving hardware cost.

Figure 3:
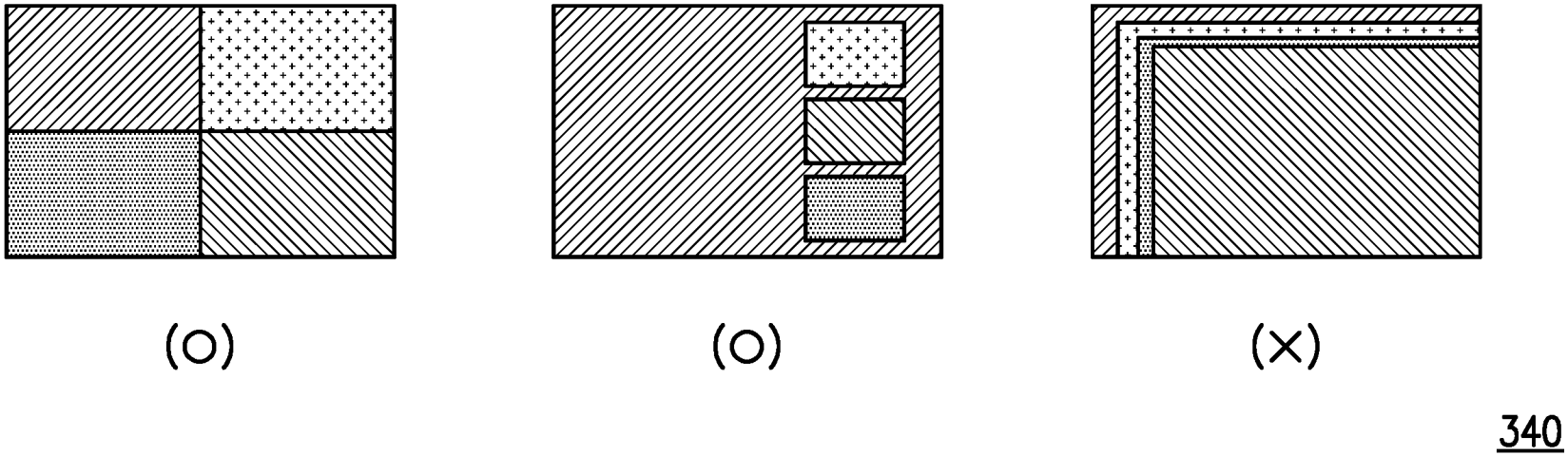
FIG. 3 is a diagram of a situation in which the invention is applied to different embodiments.

Please refer to FIG. 3. FIG. 3 is a diagram of a situation in which the invention is applied to different embodiments. In the present embodiment, a display 340 is matched to display a four-in and one-out display screen, wherein the four image sources may be adjusted to zoom in and out and move according to the user, and the number of image sources is just for convenience of description, and may be other numbers in other embodiments. In an example, the bandwidths when receiving the four image sources are all 1 unit. Without considering the processing of the portions of the four image sources blocking each other, using the example on the left of FIG. 3, the four image sources are not overlapped with each other when displayed on the display 340, each is zoomed out to fill one full screen on the display 340, and the bandwidth needed for processing and transmitting the images is equivalent to 1 unit needed for a single image source for full-screen display. Taking the example in the middle of FIG. 3, one of the image sources is displayed in full screen and the other three image sources are displayed in reduced size. In the case that the bandwidth needed for processing and transmitting the reduced image sources is about 0.3 units, the bandwidth needed for processing and transmitting the images is about 1.3 units. Taking the example on the right of FIG. 3, one of the image sources is displayed in full screen and the other three image sources are displayed in nearly full screen, and the bandwidth needed when processing and transmitting the images is close to 4 units. Therefore, as the number of image sources or stacked portions is increased, the bandwidth requirements of the hardware equipment are increased proportionally, and the computing resources of the hardware equipment are significantly occupied. If the bandwidth of the hardware equipment is insufficient, the issue that the display is abnormal or the screen refresh rate needs to be reduced occurs.

In contrast, in the example on the right of FIG. 3 of the invention, the data volume of the image pixels of the portion of the plurality of image screens blocked due to stacking may be reduced or omitted and not transmitted, and when a display screen is generated, only the transmission bandwidth and temporary storage space that are substantially the same as the display of a single screen are needed. As a result, even if there are a plurality of image information close to full screen and stacked with each other in the display screen (the image sources in the present embodiment are four as an example, but the number thereof is not limited), display may be normal without improving hardware resources. In the case of the practice of the middle example and the example on the left in FIG. 3, when there are more images close to full screen stacked with each other, if there is no corresponding increase in hardware resources and no adjustments are made to the input image, there is the issue of abnormal display or the screen refresh rate needs to be reduced.

Figure 4:
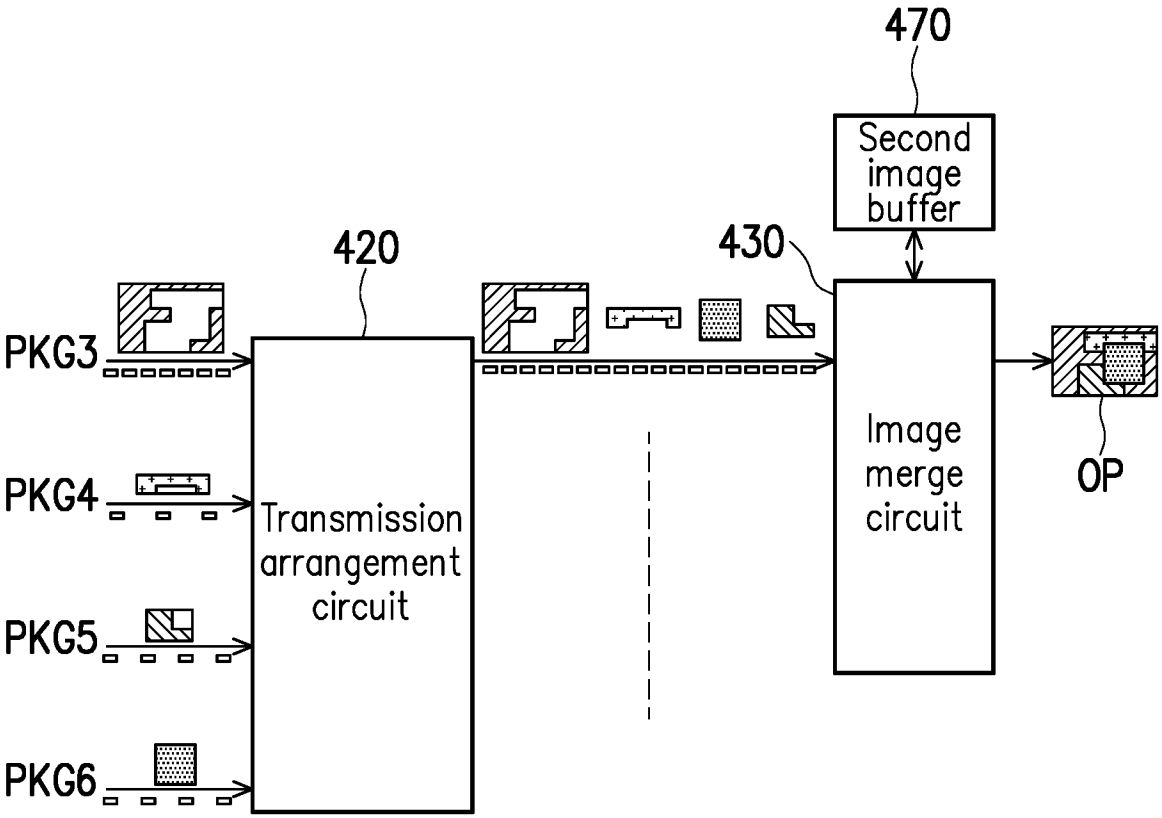
FIG. 4 is a diagram of time division multiplex transmission according to an embodiment of the invention.

Please refer to FIG. 4. FIG. 4 shows a diagram of time division multiplex transmission according to an embodiment of the invention. In particular, a transmission arrangement circuit 420, an image merge circuit 430, and a second image buffer 470 are suitable for the transmission arrangement circuit 220, the image merge circuit 230, and the second image buffer 270 in FIG. 2. In the present embodiment, the transmission arrangement circuit 420 may divide the image information packets PKG3 to PKG6 into a plurality of sub-packets in a time division multiplexing manner and transmit the sub-packets to an image merge circuit 430 in sequence. In the present embodiment, the image merge circuit 430 may temporarily store a plurality of sub-packets of the image information packets PKG3 to PKG6 using the second image buffer 470, and when the display screen of the display is refreshed, all the sub-packets of the image information packets PKG3 to PKG6 may be read from the second image buffer 470 to perform the subsequent actions of packet restoration and merging into the output image OP.

It should be mentioned that the time division multiplexing transmission of the present embodiment means that the transmission arrangement circuit 420 arranges different transmission time intervals for the sub-packets of the different image information packets PKG3 to PKG6 using the image refresh time of the display, and then sequentially transmits the sub-packets to the image merge circuit 430. For example, in the present embodiment, the complete display screen of the output image OP is composed of 18 sub-packets, containing 7, 3, 4, and 4 sub-packets occupied by the image information packets PKG3 to PKG6, respectively. Then the transmission arrangement circuit 420 may calculate the transmission time intervals of the respective sub-packets of the image information packets PKG3 to PKG6 (for example, the transmission time interval of the sub-packets of the image information packet PKG3 may be 16.6 milliseconds/7=2.37 milliseconds) using the image refresh time of the display (for example, 16.6 milliseconds/60 Hz) so as to transmit the plurality of sub-packets of the image information packets PKG3 to PKG6 in average. In this way, the time division multiplexing transmission method described in the present embodiment may avoid issues such as the image information packets PKG3 to PKG6 are divided into different numbers of sub-packets and sent at the same time thus causing the loss of sub-packets due to transmission in an overly concentrated manner at the beginning, and wasted transmission bandwidth after a portion of the sub-packets of the image information packets PKG3 to PKG6 is transmitted (for example, the image information packet PKG4 in FIG. 4 is transmitted first). Moreover, because in the invention, the output image OP is generated by reducing or not transmitting the image pixel data of the stacked and blocked portions in the display screen, the transmission bandwidth needed when the transmission arrangement circuit 420 transmits the image information packets to the image merge circuit 430 is equivalent to the transmission bandwidth of only one image information, and the transmission bandwidth and temporary storage space needed by the second image buffer 470 at most only need to be equivalent to the hardware resources needed to transmit a single image information displayed in full screen.

Figure 5A:
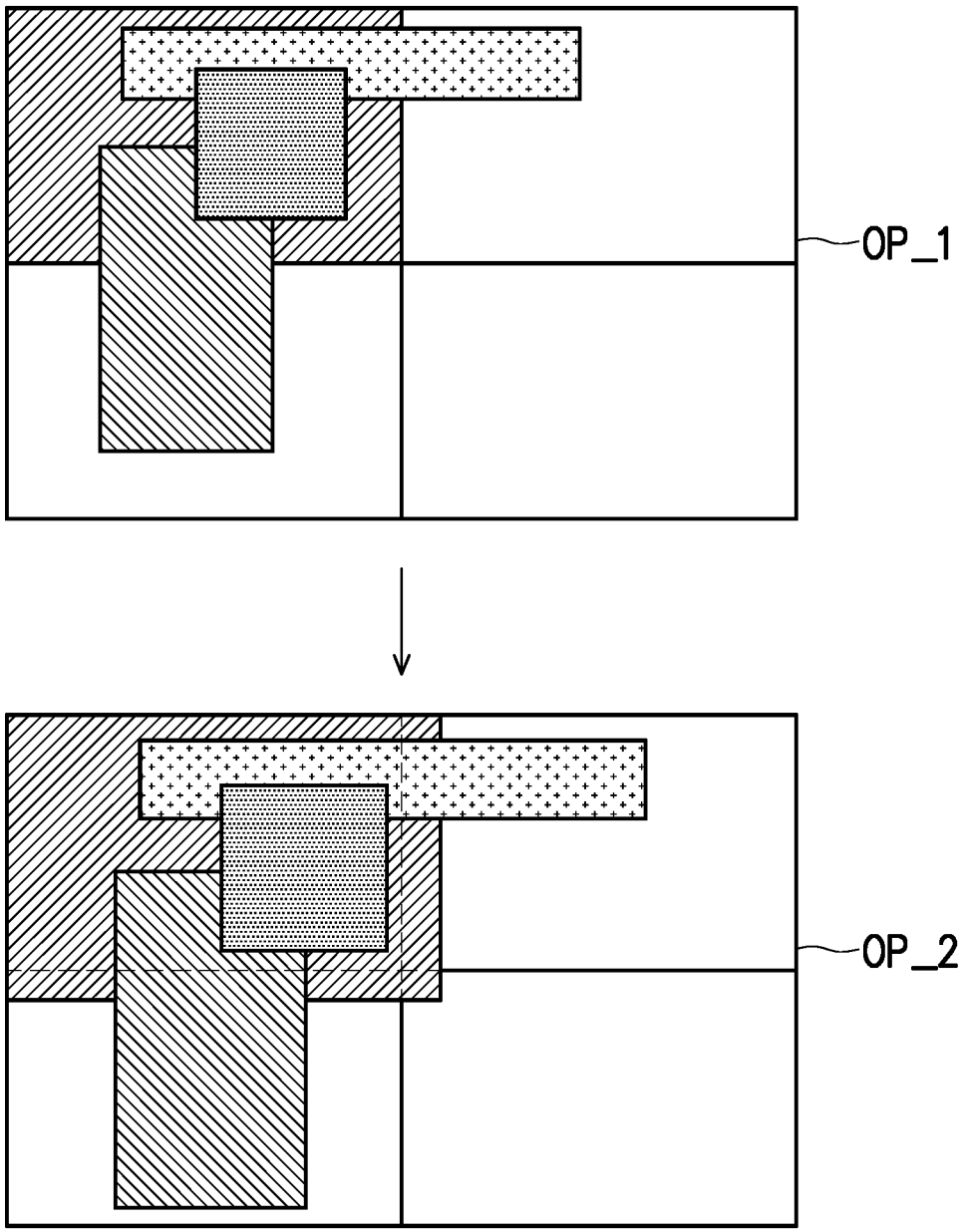
FIG. 5A to FIG. 5B are diagrams of the operation of an image processing device according to another embodiment of the invention.
Figure 5B:
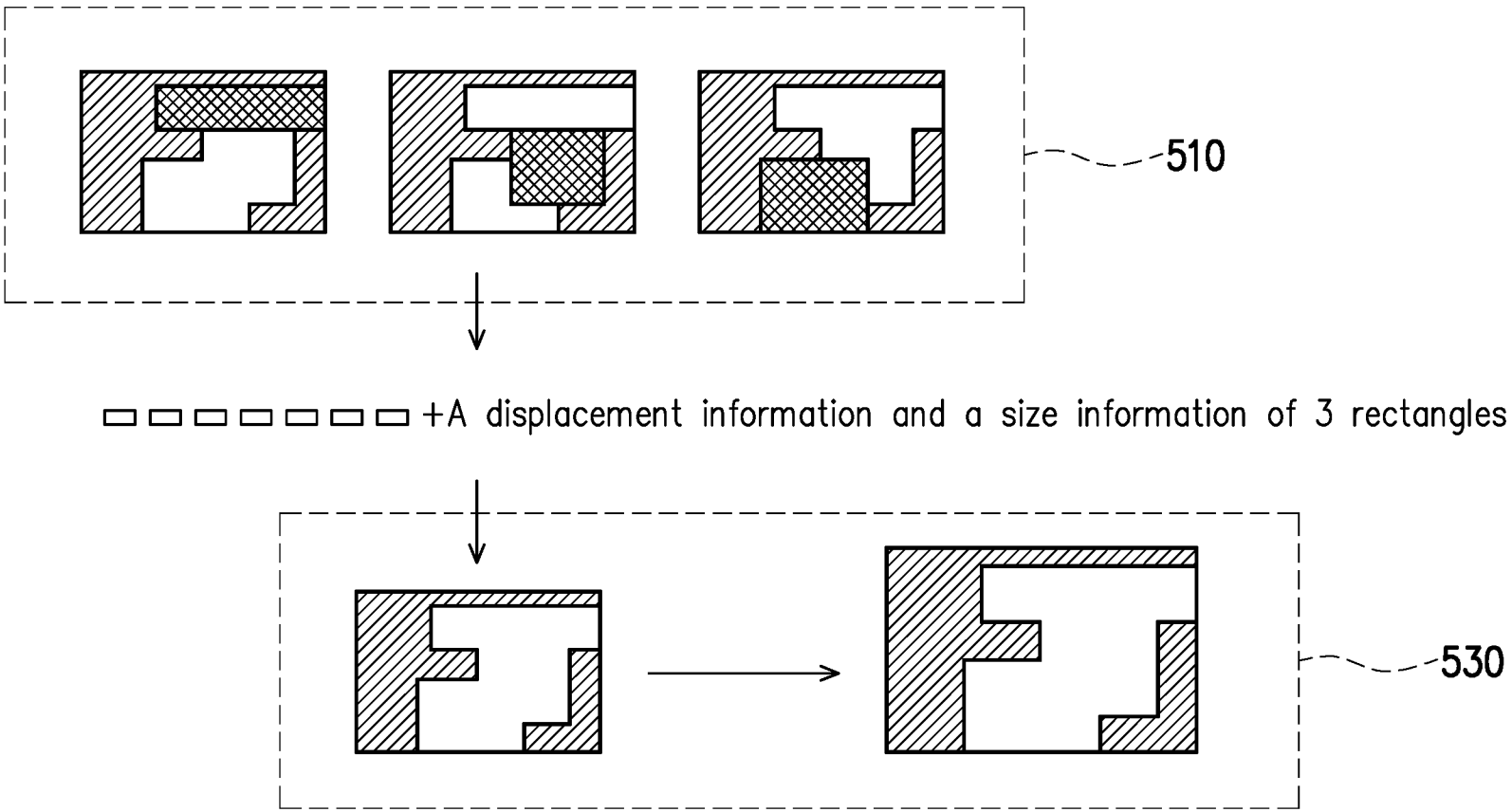

Please refer to both FIG. 5A and FIG. 5B. FIG. 5A to FIG. 5B show diagrams of the operation of an image processing device according to another embodiment of the invention. In particular, an image processing circuit 510, an image merge circuit 530, and a display 540 are suitable for the image processing circuit 210, the image merge circuit 230, and the display 240 in FIG. 2. FIG. 5A shows the image change on the display 540, and FIG. 5B shows the processing action of the image processing device for unviewable image data.

In the present embodiment, the image processing circuit 510 may separately transmit the image information packets respectively corresponding to the viewable image not blocked due to stacking and the blocked unviewable image on the display screen of the display 540 (such as the position, displacement information, and size information of unviewable image pixels) to be restored to a complete output image by the image merge circuit 530. For example, in the present embodiment, when the display image of the display 540 in FIG. 5A is scaled from an output image OP_1 to an output image OP 2, both the viewable image and the unviewable image thereof are enlarged. Then, the image processing circuit 510 in FIG. 5B may choose to first transfer the image pixel data of the viewable image in the output image OP_1 to the image merge circuit 530. Then the unviewable image data in the output image OP_1 is split into a plurality of rectangles (for example, the three rectangles in FIG. 5A), and the position information, displacement information, and size information thereof are recorded according to the origin relative to the output image OP_1 (for example, the upper left corner in the present embodiment), and then the position information, displacement information, and size information of the unviewable image are sent to the image merge circuit 530. In this way, when the image merge circuit 530 needs to perform scaling processing on the display screen of the display 540, the display screen may be restored to a normal size according to the image information of the unviewable image.

Figure 6:
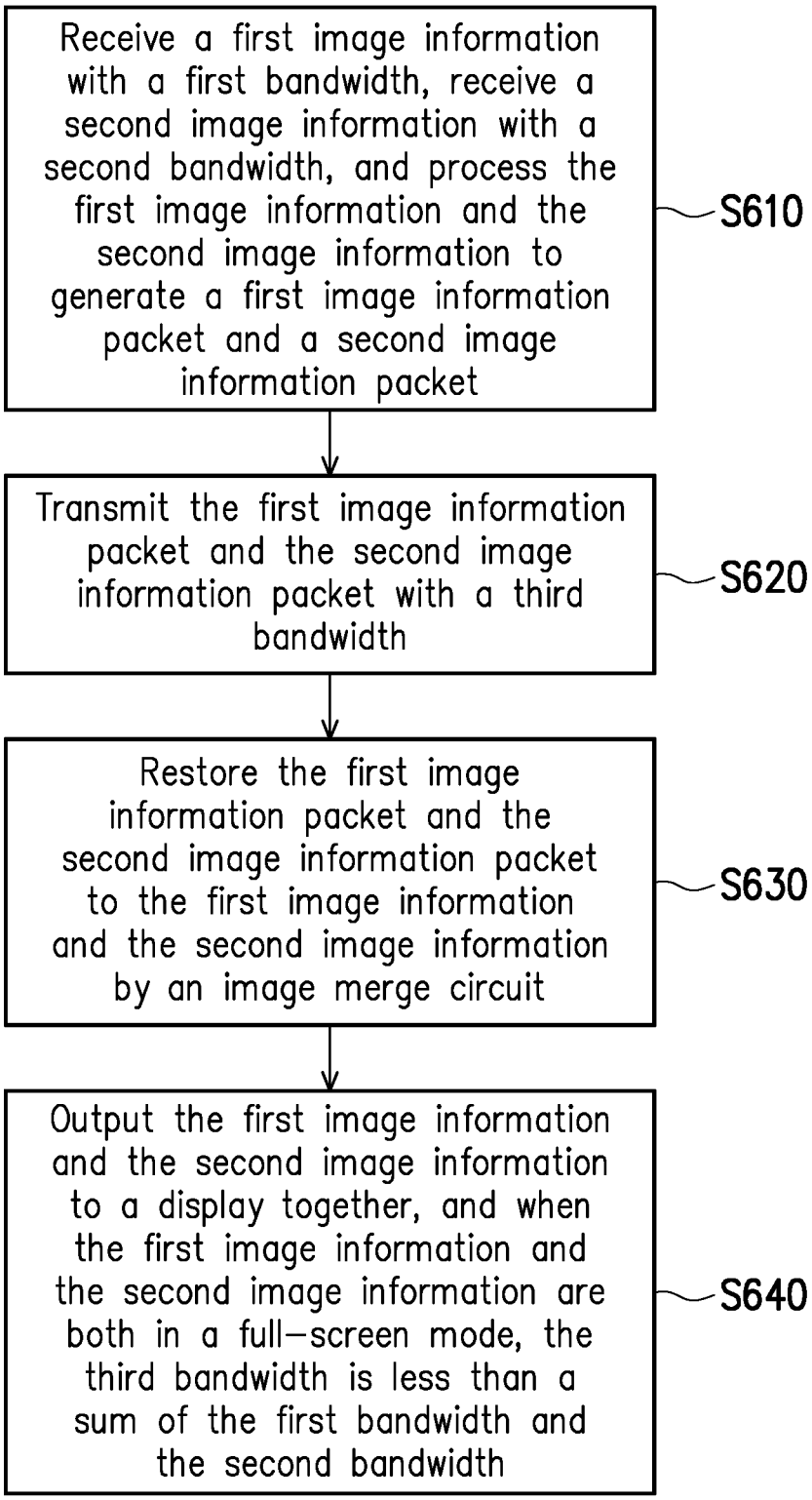
FIG. 6 is a flowchart of an image processing method according to an embodiment of the invention.

Please refer to FIG. 6. FIG. 6 shows a flowchart of an image processing method of an embodiment of the invention. The image processing method is suitable for the image processing device 100 and the display 140 including the image merge circuit 130 in FIG. 1 for implementation. In step S610, the image processing device 100 receives a first image information with a first bandwidth, receives a second image information with a second bandwidth, and processes the first image information and the second image information to generate a first image information packet and a second image information packet.

In step S620, the image processing device 100 transmits the first image information packet and the second image information packet to the image merge circuit 130 with a third bandwidth. In step S630, the first image information packet and the second image information packet are restored to the first image information and the second image information by the image merge circuit 130. In step S640, the image merge circuit 130 outputs the first image information and the second image information to the display 140 together, and when both the first image information and the second image information are in full-screen mode, the third bandwidth is less than the sum of the first bandwidth and the second bandwidth. For the implementation details of the steps of the above image processing method, please refer to the description of the above embodiments.

Based on the above, in an embodiment of the invention, the image processing device and the image processing method for displaying a multi-screen may process a plurality of image sources to reduce the data volume of undisplayed images that are blocked due to overlapped display screens, so that the undisplayed images do not occupy the transmission bandwidth of the hardware equipment. In this way, under the premise of maintaining refresh rate and not affecting display image quality, the number of superimposed input images and the display size of the image screens are not limited. Moreover, the image screens may all be displayed in a size close to full screen, and the transmission bandwidth and temporary storage space needed for the image processing device to process and transmit the image screens are not increased, thereby saving costs and reducing the complexity of hardware design.

Although the invention has been described with reference to the above embodiments, it will be apparent to one of ordinary skill in the art that modifications to the described embodiments may be made without departing from the spirit of the disclosure. Accordingly, the scope of the disclosure is defined by the attached claims not by the above detailed descriptions.

What is claimed is:

1. An image processing device, comprising:

an image processing circuit receiving a first image information with a first bandwidth, receiving a second image information with a second bandwidth, and processing the first image information and the second image information to generate a first image information packet and a second image information packet;

a transmission arrangement circuit receiving the first image information packet and the second image information packet, and an image merge circuit receiving the first image information packet with a first frame rate and the second image information packet with a second frame rate from the transmission arrangement circuit with a third bandwidth, restoring the first image information packet and the second image information packet to the first image information and the second image information, merging the first image information and the second image information to generate an output image, and outputting the output image without reducing the first frame rate of the first image information and the second frame rate of the second image information;

wherein the third bandwidth is less than a sum of the first bandwidth and the second bandwidth.

2. The image processing device of claim 1, wherein the transmission arrangement circuit transmits the first image information packet and the second image information packet to the image merge circuit with the third bandwidth in a time division multiplexing manner.

3. The image processing device of claim 1, further comprising:

a controller coupled to the image processing circuit;

wherein the controller is configured to adjust a first mask corresponding to the first image information and a second mask corresponding to the second image information according to a display window adjustment operation;

wherein the image processing circuit processes the first image information according to the first mask to generate the first image information packet, and processes the second image information according to the second mask to generate the second image information packet.

4. The image processing device of claim 3, wherein the first mask and the second mask are respectively configured to represent a first image-enabled region and a second image-enabled region relative to a full-screen region, and the first image-enabled region in the first mask and the second image-enabled region in the second mask are not overlapped with each other.

5. The image processing device of claim 1, wherein the first image information packet comprises a first image and a first image setting information, and the second image information packet comprises a second image and a second image setting information;

wherein the image merge circuit comprises an image scalar, and the image scalar configures display positions of the first image and the second image in an output image according to the first image setting information and the second image setting information, so as to integrate the first image information and the second image information into the output image;

wherein the image merge circuit provides the output image to the display, so that the display displays.

6. The image processing device of claim 5, wherein the first image setting information is configured to indicate that the first image is located at a first region in a full-screen region, the second image setting information is configured to indicate that the second image is located at a second region in the full-screen region, and the first region and the second region are not overlapped with each other.

7. The image processing device of claim 6, wherein the first image setting information comprises a displacement information and a size information of the first region relative to the full-screen region, and the second image setting information comprises a displacement information and a size information of the second region relative to the full-screen region;

wherein the image scalar configures the display positions of the first image and the second image in the output image according to the displacement information and the size information of each of the first region and the second region in the first image setting information and the second image setting information.

8. The image processing device of claim 1, further comprising:

a first image buffer coupled to the image processing circuit, wherein the image processing circuit temporarily stores the first image information and the second image information using the first image buffer.

9. The image processing device of claim 1, further comprising:

a second image buffer coupled to the image merge circuit, wherein the image merge circuit temporarily stores the first image information packet and the second image information packet using the second image buffer.

10. An image processing method for displaying a multi-screen, suitable for an image processing device comprising an image merge circuit, the image processing method comprising:

obtaining a first image information with a first bandwidth, obtaining a second image information with a second bandwidth, and processing the first image information and the second image information to generate a first image information packet and a second image information packet;

transmitting the first image information packet with a first frame rate and the second image information packet with a second frame rate to the image merge circuit with a third bandwidth; and restoring the first image information packet and the second image information packet to the first image information and the second image information by the image merge circuit;

merging the first image information and the second image information to generate an output image; and outputting the output image without reducing the frame rate of the first image information and the second frame rate of the second image information;

wherein the third bandwidth is less than a sum of the first bandwidth and the second bandwidth.

11. The image processing method of claim 10, wherein the first image information packet and the second image information packet are transmitted to the image merge circuit with the third bandwidth in a time division multiplexing manner.

12. The image processing method of claim 10, wherein the step of generating the first image information packet and the second image information packet after the first image information and the second image information are processed comprises:

adjusting a first mask corresponding to the first image information and a second mask corresponding to the second image information according to a display window adjustment operation; and processing the first image information according to the first mask to generate the first image information packet, and processing the second image information according to the second mask to generate the second image information packet.

13. The image processing method of claim 12, wherein the first mask and the second mask are respectively configured to represent a first image-enabled region and a second image-enabled region relative to a full-screen region, and the first image-enabled region in the first mask and the second image-enabled region in the second mask are not overlapped with each other.

14. The image processing method of claim 10, wherein the first image information packet comprises a first image and a first image setting information, and the second image information packet comprises a second image and a second image setting information;

wherein the step of restoring the first image information packet and the second image information packet to the first image information and the second image information comprises:

configuring display positions of the first image and the second image in an output image according to the first image setting information and the second image setting information, so as to integrate the first image information and the second image information into the output image, wherein the output image is configured to be provided to the display so that the display displays.

15. The image processing method of claim 14, wherein the first image setting information is configured to indicate that the first image is located at a first region in a full-screen region, the second image setting information is configured to indicate that the second image is located at a second region in the full-screen region, and the first region and the second region are not overlapped with each other.

16. The image processing method of claim 15, wherein the first image setting information comprises a displacement information and a size information of the first region relative to the full-screen region, and the second image setting information comprises a displacement information and a size information of the second region relative to the full-screen region;

wherein the step of integrating the first image information and the second image information into the output image comprises:

configuring the display positions of the first image and the second image in the output image according to the displacement information and the size information of each of the first region and the second region in the first image setting information and the second image setting information.

* * * * *